US010140893B2

(12) United States Patent
Strain

(10) Patent No.: US 10,140,893 B2
(45) Date of Patent: Nov. 27, 2018

(54) ENCIRCLED WRISTBAND DEVICE AND METHOD FOR REMOVAL

(71) Applicant: Jonathan Michael Strain, Lubbock, TX (US)

(72) Inventor: Jonathan Michael Strain, Lubbock, TX (US)

( * ) Notice: Subject to any disclaimer, the term of this patent is extended or adjusted under 35 U.S.C. 154(b) by 0 days.

(21) Appl. No.: 15/464,341

(22) Filed: Mar. 21, 2017

(65) Prior Publication Data

US 2018/0277023 A1 Sep. 27, 2018

(51) Int. Cl.
*G09F 3/20* (2006.01)
*G09F 3/02* (2006.01)

(52) U.S. Cl.
CPC ..... *G09F 3/20* (2013.01); *G09F 2003/0251* (2013.01)

(58) Field of Classification Search
CPC ..... A44C 5/00; A44C 5/004; A44C 5/0046; G09F 3/005; G07C 9/00015
USPC ..... 40/665, 633
See application file for complete search history.

(56) References Cited

U.S. PATENT DOCUMENTS 753,457 A * 3/1904 Weissbrod ..... A47B 23/002 16/DIG. 12
1,419,190 A * 6/1922 Zipoy ..... B42D 5/006 224/267
1,539,781 A * 5/1925 Smythe ..... G04B 37/125 224/152
1,594,215 A * 7/1926 Sides ..... A44C 5/0046 206/37
1,701,888 A * 2/1929 Hofferberth ..... A44C 5/0046 224/219
D113,859 S * 3/1939 Van Cott ..... D11/2
3,660,916 A * 5/1972 McDermott ..... G07C 9/00015 225/75
3,818,897 A * 6/1974 Smith ..... G09F 3/005 40/640
4,884,826 A * 12/1989 Slagsvol ..... B42D 1/005 281/2
4,903,932 A * 2/1990 Stewart, Jr. ..... A45F 5/00 224/267
4,906,025 A * 3/1990 Schreindl ..... A44C 5/0046 224/219
4,984,683 A * 1/1991 Eller ..... A44C 25/004 206/38
D344,628 S * 3/1994 Taggart ..... 224/267
5,299,833 A * 4/1994 Madole, Jr. ..... B42D 5/003 281/2

(Continued)

*Primary Examiner* — Cassandra Davis
(74) *Attorney, Agent, or Firm* — Sarah Hegi Simpson; McWhorter, Cobb & Johnson, LLP

(57) ABSTRACT

A wristband device that is permanently installed over the human wrist until disassembled or destroyed by removing portions of multiple layers of removable tab layers of the wristband device. The device is composed of multiple layers of removable tab layers which have removable portions of the multiple layers that may be removed to disassemble the band in an intentional step by step fashion. Upon each removable portion of each layer to be removed, information is indicated on each side to provide regimented, step-by-step information to the wearer. At the end of the regimented endeavor, removal of the final removable portion of the removable tab layer or base band layer segments the band into two discrete edges signifying the end use of the device.

19 Claims, 4 Drawing Sheets

(56) References Cited

U.S. PATENT DOCUMENTS

| | | | | |
|---|---|---|---|---|
| 5,311,689 | A * | 5/1994 | Lindsey | G09F 3/005 224/267 |
| 5,531,481 | A * | 7/1996 | Wiltshire | B42D 5/005 224/219 |
| 6,471,091 | B1 * | 10/2002 | Unverzagt | B65C 11/00 221/185 |
| 6,530,509 | B1 * | 3/2003 | Davis | A45C 11/34 224/219 |
| 2010/0159194 | A1 * | 6/2010 | Boucher | B26D 5/12 428/138 |
| 2012/0023796 | A1 * | 2/2012 | Waltersdorf | A44C 5/0015 40/633 |
| 2012/0085801 | A1 * | 4/2012 | Padilla | B42D 5/006 224/576 |
| 2016/0232820 | A1 * | 8/2016 | Koltchine | G09F 3/10 |

* cited by examiner

ENCIRCLED WRISTBAND DEVICE AND METHOD FOR REMOVAL

CROSS-REFERENCE TO RELATED APPLICATIONS

Not Applicable. None.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The wristband device has many applications to which it organizes a set of regimented tasks to achieve an overall endeavor. The device is suitable for a variety of activities and events such as regimented exercise programs, goal oriented activities and event venues to name a few. The device is installed around the human wrist to be used in situations where an overall endeavor can be broken into multiple consecutive tasks. Because the device is permanently installed until destroyed, it serves as a constant reminder and incentive to achieve each task to remove the wristband device by intentional and organized destruction. The device could be used as a coaching tool to give specific daily tasks to complete among a larger workout program. The device could also serve the same kind of purposes for educational programs and the like. The device is also suitable for events where the permanent wristband serves as identification for entry into an event with the regimented tasks being vouchers or coupons to be used at the event.

BRIEF SUMMARY OF THE INVENTION

A wristband device comprised of layers of material that is permanently worn around a human wrist until an endeavor or goal is complete. The device segments the endeavor or goal into smaller individual tasks by the use of multiple layers of removable tab layers built upon a base band layer. Each removable tab layer of the device indicates information in the form of consecutive tasks that are to be completed. Once a task is complete, a portion of each removable tab layer to which its information was attached, is removed by the wearer to reveal the next removable portion of the next removable tab layer to which the next task is attached. The wearer of the device continues to complete tasks and remove consecutive removable tab layers of the wristband device until the final removable tab layer is removed from the base band layer, breaking the permanence of the wristband device.

Figure 2:
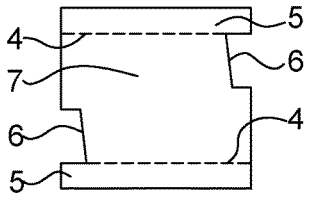
FIG. 2—PLAN VIEW OF REMOVABLE TAB LAYER. This view shows the front of a removable tab layer as it would be before being affixed to another removable tab layer or to a base band layer of the wristband device. This view indicates a portion of the removable tab layer that is to be removed called a removable portion.
Figure 3:
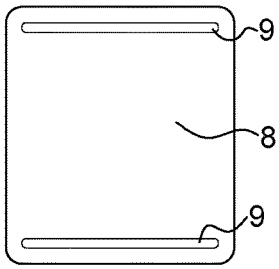
FIG. 3—PLAN VIEW OF OPTIONAL WRISTBAND LINK. This view shows the front of the optional wristband link. This part is optional and not required for the wristband device. This part allows other optional devices to be installed onto the wristband device by connecting to, or replacing, the wristband link. The wristband link serves as a connector between the two initial discrete ends of the un-encircled wristband device.

DETAILED DESCRIPTION OF THE INVENTION:

The wristband device as shown in the multiple views can be used for multiple activities and uses dependent on the information or task indicated on the multiple layers of removable tab layers 3 and the base band layer 1 of the device. The device is intended to be worn around a human wrist for short periods of time to complete a regimented endeavor. The time period to which the device is encircled and installed without removal is dependent on the number of removable tab layers (see removable tab layer shown in FIG. 2) included on the device. The device can be composed of various materials with varying levels of durability so that it may be worn in all environments at all times until the endeavor is complete. The process to which the device is manufactured is dependent on the material the device is to be constructed from. It is anticipated that over time, the device may be manufactured by newer technologies, such as three-dimensional printing, as those technologies develop. The most common material to be used in the construction of the device, as shown in the multiple views, is intended to be non-woven HDPE fabric as manufactured by Tyvek by DuPont Corporation. The device material could be cut down from stock dimensions by die cutting, knife cutting, laser or water jet techniques to cut, perforate and shape the device and its relative components as designed both functionally and aesthetically. Some parts of the device, such as the optional wristband link FIG. 3, may be manufactured the same as well as other techniques like injection moulding or three-dimensional printing. The method for depicting information on the wristband device is dependent on the material used to construct it. Offset, flexographic, inkjet and digital printing techniques can be used to impose information on the material substrate. Likewise, information may be embossed, debossed, or formed on the material substrate in various material processes when the material of the device allows.

Figure 1:
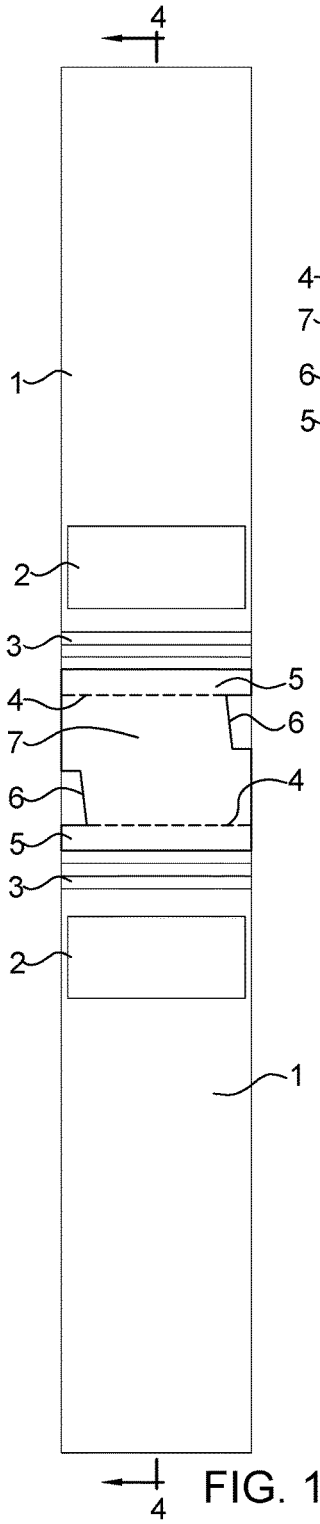
FIG. 1—PLAN VIEW OF WRISTBAND DEVICE BEFORE ENCIRCLED. This view shows the front of the wristband device as it would be sold in a retail environment and as it would be after being manufactured.

As shown in FIG. 1. multiple layers 3 of removable tab layers (FIG. 2) are layered upon a base band layer 1. The area between the perforations 4 and the outer edge of the removable tab layer 5 is adhered to the layer beneath it keeping the area between the top and bottom perforations, the removable portion 7, connected to the device only by the material connections between each individual perforation 4. The number of removable tab layers (FIG. 2) can be of any multiples layered upon a base band layer 1. Each base band layer 1 and removable tab layer (FIG. 2) has information indicated on each, top and bottom, side of the removable tab portion 7 to provide regimented information to the wearer during the task. Other information and graphics for additional instructions, graphic details, and aesthetic appeal are intended to be indicated on the balance of the field of the wristband device as well.

Figure 4:
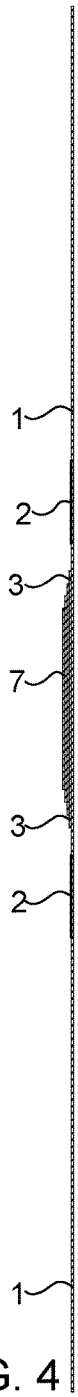
FIG. 4—SECTION VIEW THROUGH WRISTBAND DEVICE BEFORE ENCIRCLED. This view shows a cross section of the device as noted in other views. This view shows the build up of multiple layers of removable tab layers over a base band layer. This view shows the device in section as it would be sold in a retail environment and as it would be after being manufactured.
Figure 5:
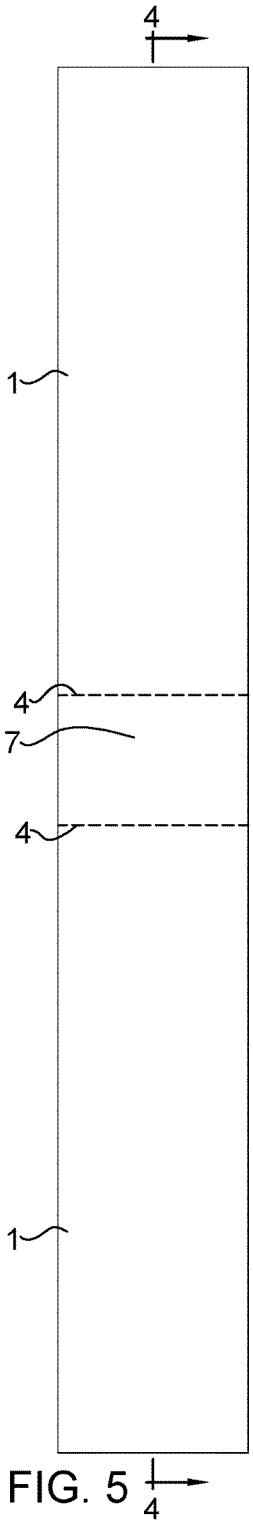
FIG. 5—PLAN VIEW OF WRISTBAND DEVICE BEFORE ENCIRCLED. This view shows the back of the device as it would be sold in a retail environment and as it would be after being manufactured.
Figure 6:
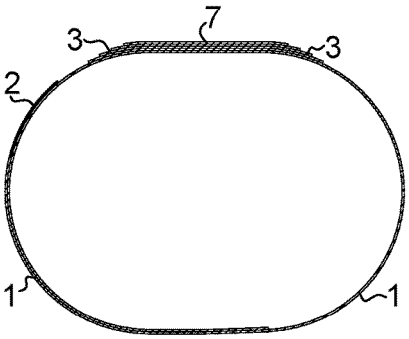
FIG. 6—SECTION VIEW OF WRISTBAND DEVICE AFTER ENCIRCLED. This view shows a section view of the device as noted in other views. This view shows the device encircled on itself and connected by permanent adhesive or other permanent fastener. This view shows multiple layers of removable tab layers over a base band layer.
Figure 9:
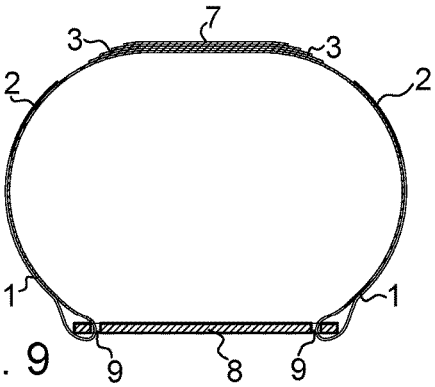
FIG. 9—SECTION VIEW OF WRISTBAND DEVICE AFTER ENCIRCLED WITH OPTIONAL WRISTBAND LINK SHOWN. This view shows a section view of the device as noted in other views. This view shows the device encircled on itself by permanent adhesive, or other permanent fastener, with the optional wristband link installed. This view shows multiple layers of removable tab layers affixed to a base band layer.
Figure 7:
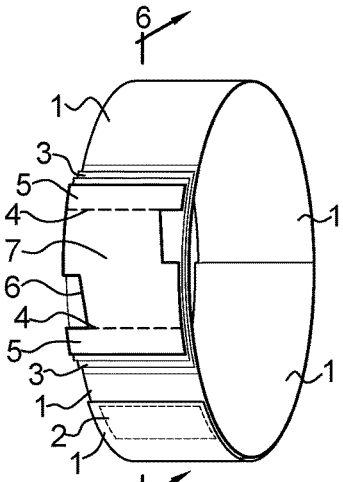
FIG. 7—PERSPECTIVE VIEW OF WRISTBAND DEVICE AFTER ENCIRCLED. This view shows the outside view of the device once encircled. The multiple layers of removable tab layers are shown affixed to the base band layer completing a full encircled device. The device, as shown, is permanently encircled until destroyed.
Figure 10:
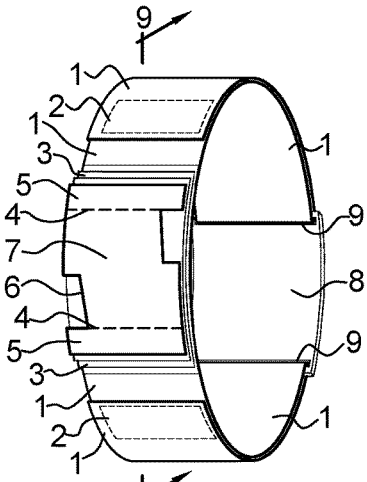
FIG. 10—PERSPECTIVE VIEW OF WRISTBAND DEVICE AFTER ENCIRCLED WITH OPTIONAL WRISTBAND LINK SHOWN. This view shows the outside view of the device once encircled. The multiple layers of removable tab layers are shown affixed to a base band layer completing a fully encircled device. This view shows the optional wristband link installed.
Figure 8:
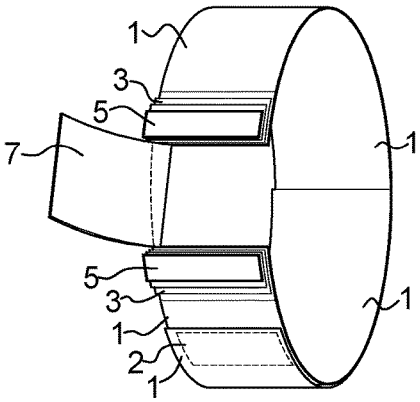
FIG. 8—PERSPECTIVE VIEW OF WRISTBAND DEVICE AFTER ENCIRCLED WHERE REMOVABLE PORTION OF BASE BAND LAYER IS SHOWN REMOVED. This view shows the outside view of the wristband device once encircled. The removable portion of the multiple layers of removable tab layers are shown to have been removed with the removable portion of the base band layer in process of being removed.
Figure 11:
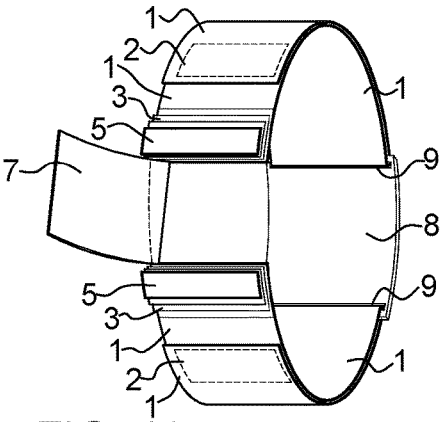
FIG. 11—PERSPECTIVE VIEW OF WRISTBAND DEVICE AFTER ENCIRCLED WITH OPTIONAL WRISTBAND LINK SHOWN AND REMOVABLE PORTION OF BASE BAND LAYER IS REMOVED. This view shows the outside view of the device once encircled. The removable portion of the multiple layers of removable tab layers are shown to have been removed with the removable portion of the base band layer in process of being removed. This view shows the optional wristband link installed.
Figure 12:
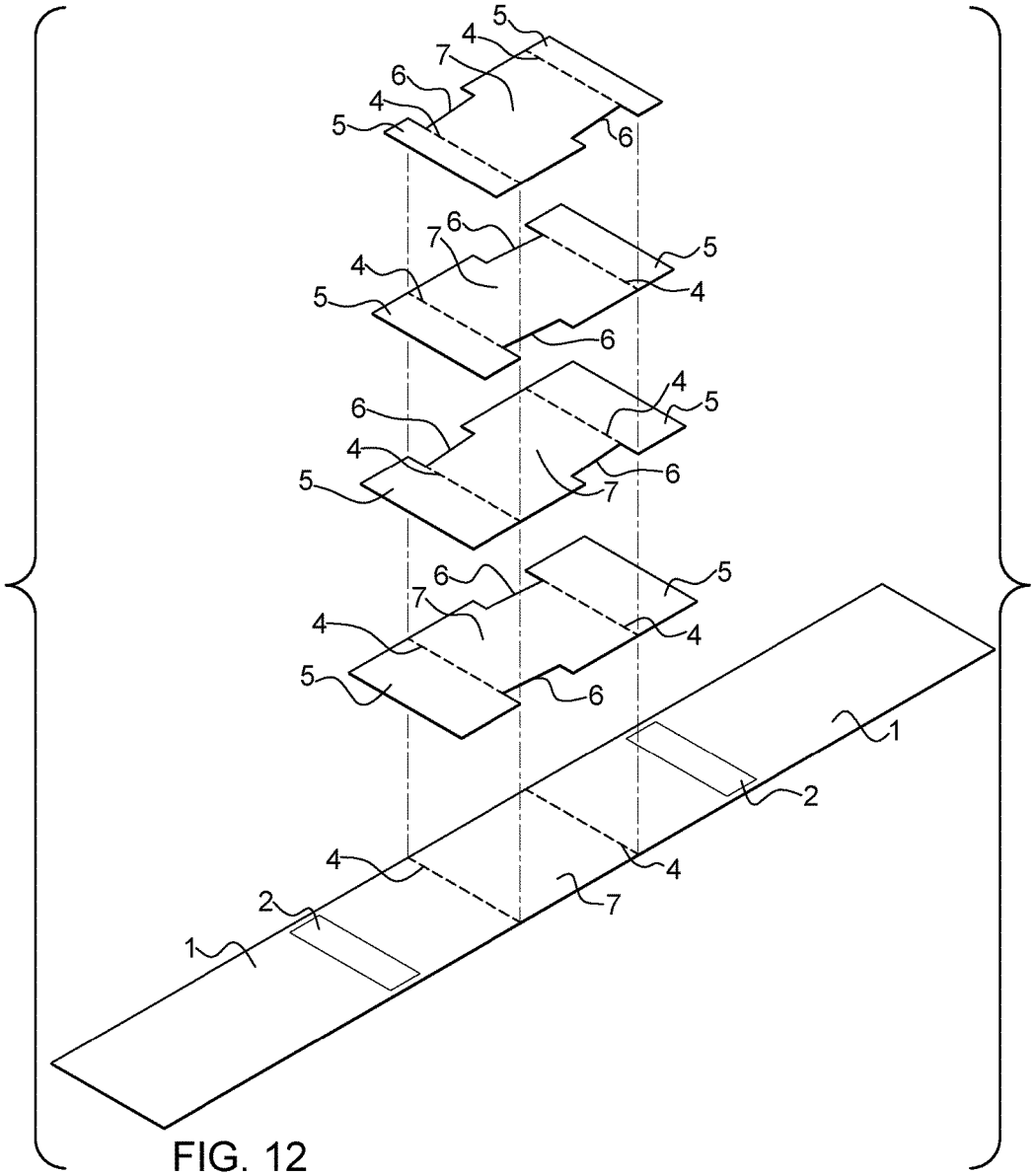
FIG. 12—EXPLODED VIEW OF WRISTBAND DEVICE. This view shows the device exploded with multiple layers of removable tab layers and their relationship to a base band layer. This view shows the orientation of multiple layers of removable tab layers as they relate to a base band layer once affixed in the manufacturing process. This view shows the wristband device before it is encircled.
Figure 13:
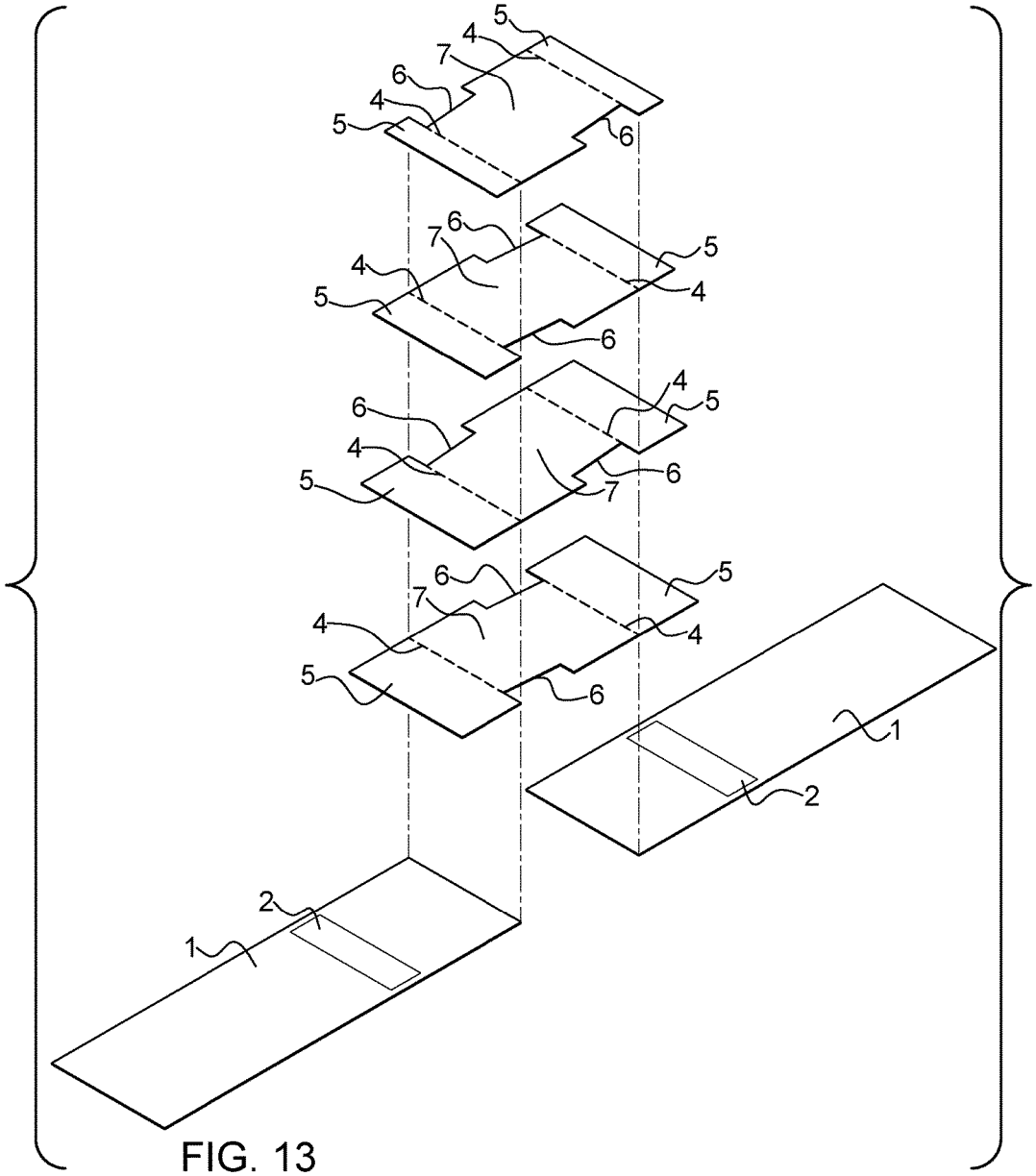
FIG. 13—EXPLODED VIEW OF WRISTBAND DEVICE WHERE BASE BAND LAYER OF WRISTBAND IS SEGMENTED. This view shows the device exploded with multiple layers of removable tab layers and their relationship to a base band layer. This view shows the orientation of multiple layers of removable tab layers as they relate to a base band layer once affixed in the manufacturing process. This view shows the wristband device before it is encircled.

The wearer installs the device around the human wrist by wrapping the device around the wrist with the front of the device facing up. The front face of the device is shown in FIG. 1 and the back face of the device is shown in FIG. 5. FIG. 4 shows the front of the wristband device to the left, in section, while FIGS. 6 and 9 show the front of the wristband device facing up, in section. FIGS. 7, 8, 10 and 11 show the front of the wristband device facing out where the removable portion 7 is intended to be the front of the device. Pressure sensitive adhesive 2 may be used to permanently attach the base band layer 1 to itself once encircled around the wrist. The pressure sensitive adhesive 2 may be adhered to the base band layer 1 in the manufacturing process in a permanent location as shown in FIG. 12 and FIG. 13 and respective multiple views. The location of the pressure sensitive adhesive or other permanent fastener 2 is dependent on the size and aesthetic design of the band. The pressure sensitive adhesive 2 may be temporarily covered with release liner until the device is installed around the wrist. The device becomes encircled once the pressure sensitive adhesive or other permanent fastener 2 and the base band layer 1 become affixed to each other as shown in FIGS. 7, 8, 10 and 11. FIGS. 7-8 show the device as it would be encircled with one location of pressure sensitive adhesive 2. FIG. 10 and FIG. 11 show the device as it would be encircled by using the optional band link 8. The quantity and location of pressure sensitive adhesive or other permanent fasteners 2 for the purposes of enclosing the wristband device are dependent on the size and aesthetic design of the band. Additionally, when the optional wristband link 8, or other substituting component is used, at least two locations of pressure sensitive adhesive 2 may be necessary.

The optional wristband link 8 is a connector that can be used to place other objects on the wristband device. The link 8 is not required to install and use the wristband device but optionally available with future accessories. The optional wristband link 8 can also be replaced completely with other devices such as watch faces and the like. The optional wristband link 8 can be made of various materials with varying levels of durability so that it may be worn in all environments at all times until the endeavor is complete. The wristband link 8 has two slots 9 cut or formed into it to allow the base band layer 1 of the wristband device to pass through as shown in FIG. 9, FIG. 10, and FIG. 11. Once the base band layer 1 of the wristband device passes through the slots 9 in the optional wristband link 8, the wristband device is encircled on the wrist by using two locations of pressure sensitive adhesive or other permanent fasteners 2 as shown in FIG. 10. FIG. 10 and FIG. 11 show the device as it would be encircled by using the optional wristband link 8. The area of the link 8 between slots 9 on the optional wristband link is where optional devices can be mounted or additional wearer information may be placed.

The base band layer 1 and multiple layers of removable tab layers 3 have perforations 4 to allow removable portions 7 of the multiple layers of removable tab layers 3 and the removable portion 7 of the base band layer 1 to be removed. Graphics and other information may be provided on each side of the removable portion 7 of each removable tab layer and base band layer. As the wearer removes removable portions 7 of removable tab layer (FIG. 2), the permanently affixed portions 5 between the perforations 4 and the outer edge of the removable tab layer remains permanently attached to the base band layer 1 and consecutive multiple layers of removable tab layers 3. As each removable portion 7 is removed from the wristband device it reveals the removable portion 7 of the next removable tab layer (FIG. 2) as shown in the multiple views. Once the last removable portion 7 of the removable tab layer or base band layer 1 is removed, the wristband device breaks into two discrete edges along the plane of the original perforations 4, breaking the encirclement of the band as shown in FIG. 8 and FIG. 11.

The non-affixed sides of the removable portion 7 of each removable tab layer (FIG. 2) may be notched 6 to allow the wearer a grasping portion of the removable tab 7 for the regimented removal process of the wristband device. Each non-affixed side of the removable portion 7 has this notched area 6 to provide an ambidextrous condition so that the wristband device may be worn on either left or right parts of the human body. During the manufacturing process, the location of notches 6 in the removable tab layers FIG. 2 may be mirrored along the centerline between the permanently affixed portions 5 of the removable tab layers to conceal the notch 6 on the removable portion 7 below as shown in FIG. 12 and FIG. 13 and the other multiple corresponding views. This orientation of notches 6 prevents the wearer from grasping multiple removable tab portions 7 at once during the removal process. The top or bottom edges of the notches 6 may overlap over the centerline to completely conceal the top or bottom edge of the notch or notches 6 on the consecutive removable tab portion 7 providing additional protection from grasping multiple layers of removable tabs 7 at once. Once the wearer grasps one of the notches 6 on each removable portion 7 of the removable tab layer, the removable portion 7 is removed from the wristband device by pulling the removable portion parallel with the perforations 4 as shown in FIG. 8 and FIG. 11. As shown in FIG. 12, FIG. 13 and the multiple corresponding views, the material that is left between each perforation 4 is what provides the connection of the removable portion 7 to its permanently affixed portion 5 and to the base band layer 1. Therefore, when the removable portion 7 is pulled away from the permanently affixed portion 5 and/or the base band layer 1, destroying the connection between the perforations 4, and having removed all removable portions 7, the encirclement of the wristband device segments into two discrete edges along the plane of the perforations 4, which segment the encirclement of the band and signify the end use of the wristband device.

The invention claimed is:

1. A wristband comprising:

an elongated base band layer of flexible material having sufficient length to encircle a human wrist, said base band layer having a top side and bottom side, said base band layer further comprising a removable portion of flexible material, said removable portion having a top side and a bottom side;

a permanent fastener affixed to said base band layer to allow for encirclement of said base band layer around said human wrist;

a plurality of perforations separating said removable portion of said base band layer from said base band layer to allow for removal of said removable portion from said base band layer; and a plurality of removable tab layers layered upon and affixed to said base band layer, said plurality of removable tab layers being disposed on top of said removable portion of flexible material of said base band layer, wherein said removable tab layers are stacked one on top of another, and wherein each of said removable tab layers comprise:

a removable portion, a permanently affixed portion at opposing ends of each of said removable tab layers providing attachment to a permanently affixed portion of any preceding tab layer and providing attachment to said base band layer, and a plurality of perforations separating said removable portion of said removable tab layer from said base band layer and separating said removable portion of said removable tab layer from said permanently affixed portion.

2. The wristband of claim 1, further comprising a wristband link including a first slot and a second slot arranged at opposing ends of said link, wherein a first end of said base band layer is arranged and configured to thread through said first slot and a second end of said base band layer is arranged and configured to thread through said second slot, thereby incorporating said link into encirclement of said base band layer around said human wrist.

3. The wristband of claim 1, wherein said permanent fastener defines a pressure sensitive adhesive.

4. The wristband of claim 1, wherein each of said removable tab layers comprises one or more notches in said removable portion, said notches being arranged and configured to aid in removal of said removable portion.

5. A wristband device comprising:

an elongated base band layer of material, said base band layer having a top side and bottom side, said base band layer further comprising a removable portion of flexible material; and one or more removable tab layers layered upon and affixed to said base band layer, wherein said one or more removable tab layers are stacked one on top of another, said one or more removable tab layers being disposed on top of said removable portion of flexible material of said base band layer, and wherein each of said removable tab layers comprises:

a removable portion, and one or more permanently affixed portions, said one or more permanently affixed portions providing attachment to a permanently affixed portion of any preceding tab layer, and said one or more permanently affixed portions providing attachment of said removable tab layer to said base band layer, wherein said removable portion of each of said removable tab layers is separable from said base band layer and wherein said removable portion of each of said removable tab layers is separable from said permanently affixed portion.

6. The wristband device of claim 5, further comprising a plurality of perforations separating said removable portion of said base band layer from said base band layer to allow for removal of said removable portion from said base band layer.

7. The wristband device of claim 5, further comprising a permanent fastener affixed to said base band layer, said fastener being arranged to allow for encirclement of said base band layer around a human wrist.

8. The wristband device of claim 7, wherein said device is removed from encirclement around said wrist by removing said removable portion of each of said removable tab layers and by removing said removable portion of said base band layer.

9. The wristband device of claim 5, further comprising a plurality of perforations separating said removable portion of said removable tab layers from said base band layer and separating said removable portion of said removable tab layers from said permanently affixed portions of said removable tab layers.

10. A wristband device comprising:

an elongated base band layer of material, said base band layer having a top side and bottom side; and one or more removable tab layers layered upon and affixed to said base band layer, wherein said removable tab layers are stacked one on top of another, and wherein each of said removable tab layers comprises:

a removable portion, and one or more permanently affixed portions, said one or more permanently affixed portions providing attachment to a permanently affixed portion of any preceding tab layer, and said one or more permanently affixed portions providing attachment of said removable tab layer to said base band layer, wherein said one or more permanently affixed portions include a first permanently affixed portion arranged at one end of each of said removable tab layers and a second permanently affixed portion arranged at an opposing end of each of said removable tab layers, wherein said removable portion of each of said removable tab layers is separable from said base band layer and wherein said removable portion of each of said removable tab layers is separable from said permanently affixed portion.

11. A wristband device comprising:

an elongated base band layer of material, said base band layer having a top side and bottom side, said base band layer further comprising a removable portion of flexible material; and one or more removable tab layers layered upon and affixed to said base band layer, wherein said removable tab layers are stacked one on top of another, said removable tab layers being disposed on top of said removable portion of flexible material of said base band layer, and wherein each of said removable tab layers comprises:

one or more permanently affixed portions providing attachment to said base band layer, and a removable portion, said removable portion of each of said removable tab layers being attached to said base band layer via a detachable attachment to said one or more permanently affixed portions, wherein said removable portion of each of said removable tab layers is separable from said wristband device by detaching said removable portion from said one or more permanently affixed portions of said removable tab layer.

12. The wristband device of claim 11, wherein said base band layer further comprises a removable portion.

13. The wristband device of claim 12, further comprising a plurality of perforations separating said removable portion of said base band layer from said base band layer to allow for removal of said removable portion from said base band layer.

14. The wristband device of claim 12, further comprising a permanent fastener affixed to said base band layer, said fastener being arranged to allow for encirclement of said base band layer around a human wrist.

15. The wristband device of claim 14, wherein said device is removed from encirclement around said wrist by removing said removable portion of each of said removable tab layers and by removing said removable portion of said base band layer.

16. The wristband device of claim 11, further comprising a plurality of perforations separating said removable portion of said removable tab layers from said base band layer and separating said removable portion of said removable tab layers from said permanently affixed portions of said removable tab layers.

17. The wristband device of claim 11, further comprising a first permanently affixed portion arranged at one end of said removable tab layers and a second permanently affixed portion arranged at an opposing end of said removable tab layers.

18. The wristband device of claim 11, wherein said one or more permanently affixed portions provide attachment to a permanently affixed portion of any preceding tab layer.

19. The wristband device of claim 11, wherein said detachable attachment defines a plurality of perforations.

* * * * *